US006619519B1

(12) United States Patent
Nix et al.

(10) Patent No.: US 6,619,519 B1
(45) Date of Patent: Sep. 16, 2003

(54) MULTI-COMPARTMENT PACK

(75) Inventors: Ronald Scott Nix; Cynthia Nelson, both of Longmont, CO (US)

(73) Assignee: Scott Nix, Longmont, CO (US)

( * ) Notice: Subject to any disclaimer, the term of this patent is extended or adjusted under 35 U.S.C. 154(b) by 0 days.

(21) Appl. No.: 09/354,887

(22) Filed: Jul. 16, 1999

(51) Int. Cl.[7] ..... A45F 4/02

(52) U.S. Cl. ..... 224/153; 224/600; 224/627; 224/637; 224/664

(58) Field of Search ..... 224/153, 600, 224/627, 637, 639, 640, 646, 647, 648, 649, 660, 664, 665, 682, 684, 257, 259, 576; 2/311, 312, 316, 321, 322

(56) References Cited

U.S. PATENT DOCUMENTS

| | | | | | |
|---|---|---|---|---|---|
| 4,085,873 | A | | 4/1978 | Schweitzer | |
| 4,096,978 | A | * | 6/1978 | Noice | 224/640 |
| 4,561,576 | A | | 12/1985 | Lowe et al. | |
| 4,726,077 | A | * | 2/1988 | Batiste | 2/321 |
| 5,129,560 | A | | 7/1992 | Herman | |
| 5,341,973 | A | * | 8/1994 | Dawes et al. | 224/637 X |
| 5,452,476 | A | * | 9/1995 | Jenks | 2/311 X |
| 5,465,888 | A | | 11/1995 | Owens | |
| 5,603,441 | A | | 2/1997 | Easter | |
| 5,649,658 | A | * | 7/1997 | Hoffman et al. | 224/153 X |
| 5,653,337 | A | | 8/1997 | Cirigliano | |
| 5,727,720 | A | * | 3/1998 | Thatcher | 224/664 |
| 5,927,575 | A | * | 7/1999 | Gatling | 224/153 |
| 5,950,896 | A | * | 9/1999 | Theodore | 224/647 |
| 5,964,384 | A | * | 10/1999 | Young | 224/664 X |
| D418,673 | S | * | 1/2000 | Madsen | D3/216 |

* cited by examiner

*Primary Examiner*—Gregory M. Vidovich
*Assistant Examiner*—Maerena W. Brevard
(74) *Attorney, Agent, or Firm*—Margaret Polson; Patent Law Offices of Rick Martin, P.C.

(57) ABSTRACT

The present invention comprises a backpack having a plurality of compartments and modes. Each compartment has a plurality of pockets. The pockets are designed to hold tools or other items in an individual manner. The invention also comprises a waist belt having two quick release clips or buckles to be removable along with its belly pack. The buckles also allow a user to open the waistband and then to turn the pack around the user's body so the back can be accessed by the user without the need to remove the pack from the user's body. The invention also comprises a water source in the pack. A dedicated compartment allows a user to place a water container in the pack for transport and storage of water. This also allows a user ready access the water while engaged in an activity. A bicyclist can carry the rear bag on his back in a first mode. He can disconnect one buckle to rotate the rear back to his belly for a second mode. He can disconnect the waist band and belly pack for a third mode.

13 Claims, 4 Drawing Sheets

MULTI-COMPARTMENT PACK

FIELD OF THE INVENTION

The present invention relates to packs, more particularly to backpacks used for carrying tools having a plurality of compartments, and which can be accessed by a user without removing the pack from the user's back.

BACKGROUND OF THE INVENTION

Packs and backpacks are well known in the art. They are used to carry items on a user's person. The number of uses is as varied as the users. The packs generally comprise a bag or duffel, which is hung from the user's body. Usually it hangs from the user's shoulders. More complicated arrangements include a waist belt. The waist belt transfers part of the load to the user's hips and also operates to stabilize the load. The shoulder straps are usually adjustable, allowing the user to place the load in an optimal position. However, the prior art packs comprise a few compartments. These compartments are not identified for specific uses and are generally designed to allow a user to broadly segregate whatever it is that's being carried. Further, the packs are not dedicated to a single use and user. The prior art packs fall into the "one-size-fits-all" approach. As a result a user is forced to take a pack intended for a broad range of uses and then modifying it for a specific use.

Further, packs having belts generally open with a single buckle located in the front. This limits the flexibility of the pack in being positioned in various modes for differing uses.

Representative of the art is:

U.S. Pat. No. 5,653,337 (1997) to Cirigliano discloses a reversible tote bag of foldable construction for containing workman's tools.

U.S. Pat. No. 5,603,441 (1997) to Easter discloses a multi-purpose front/back pack having compartments and a frame for carrying a gun.

U.S. Pat. No. 5,465,888 (1995) to Owens discloses a cycling belt to be worn by a rider on the riders back for carrying various items for use by a child on a back seat.

U.S. Pat. No. 5,129,560 (1992) to Herman discloses a utility bag system to be worn by a person whereby the utility bags are worn adjacent to the body.

U.S. Pat. No. 4,561,576 (1985) to Lowe discloses a video bag used to transport video equipment having a plurality of compartments for storing various video components.

U.S. Pat. No. 4,085,873 (1978) to Schweitzer discloses a knapsack having a pouch for self storage of the knapsack and which is used to carry tennis racquet and balls.

What is needed is a multi-compartment pack having a plurality of compartments. What is needed is a multi-compartment pack having dual quick release connections in a waist belt. What is needed is a multi-compartment pack having a compartment for a water source. What is needed is a multi-compartment pack having a plurality of pockets in each compartment for holding individual items. What is needed is a multi-compartment pack having a detachable waist pack. What is needed is a multi-compartment pack having two full size compartments in the pack. The present invention meets these needs.

SUMMARY OF THE INVENTION

The primary aspect of the invention is to provide a multi-compartment pack having a plurality of compartments.

Another aspect of the invention is to provide a multi-compartment pack having dual quick release connections in the waist belt.

Another aspect of the invention is to provide a multi-compartment pack having a compartment for a liquid source.

Another aspect of the invention is to provide a multi-compartment pack having a plurality of pockets in each compartment for holding individual items.

Another aspect of the invention is to provide a multi-compartment pack having a detachable waist pack.

Another aspect of the invention is to provide a multi-compartment pack having two full size compartments in the pack.

Other aspects of this invention will appear from the following description and appended claims, reference being made to the accompanying drawings forming a part of this specification wherein like reference characters designate corresponding parts in the several views.

The present invention comprises a backpack having a plurality of compartments. Each compartment has a plurality of pockets. The pockets are designed to hold tools or other items in an individual manner. The invention also comprises a waist belt having quick release clips. The clips allow a user to open the waistband and then to turn the pack around the user's body so the back can be accessed by the user without removing the pack from the user's back. The invention also comprises a liquid source in the pack. A dedicated compartment allows a user to place a liquid container in the pack for transport and storage of a liquid. This also allows a user to access the liquid while engaged in an activity.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
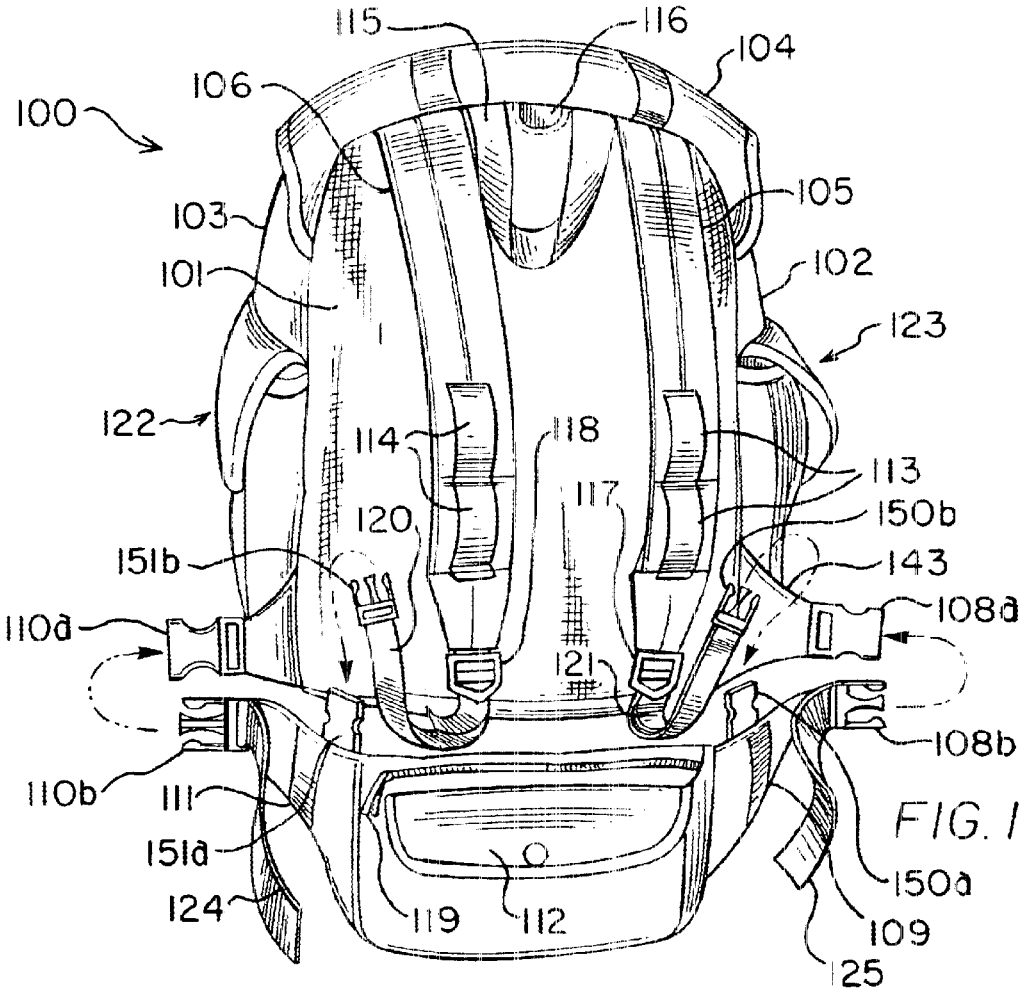
FIG. 1 is a front perspective view of the preferred embodiment of the invention showing the belly pouch fully detached.

FIG. 1 is a perspective view of the invention. The invention, or pack, 100 comprises rear panel 101, which is connected to left side panel 102 and right side panel 103. Flap 104 covers the opening of the pack. Shoulder straps 105 and 106 connect to rear panel 101. The pack is generally made of any suitable material including but not limited to nylon, cotton, or other tough durable material used in the art for such purposes. Belt 109 and 111 is connected to pack at connection 143 and 144 respectively. Clip 150 and clip 151 allow a user to quickly disconnect the shoulder straps from the waist belt, making it easier for a user to take off the pack.

The invention further comprises belly pouch 107. Pouch 107 is connected to a lower portion of rear panel 101 by buckles 108 and 110. Pouch belts 109 and 111 are connected to each side of 1I pouch 107 and are threaded through buckles 108 and 110 respectively. The length of pouch belt 109 and 111 may be adjusted to accommodate a range of users. A user may adjust the fit by pulling on belt tail 124 and 125. Belly pouch 107 further comprises cover flap 112 and zipper 119. Zipper 119 allows quick access to an interior of belly pouch 107.

Figure 2:
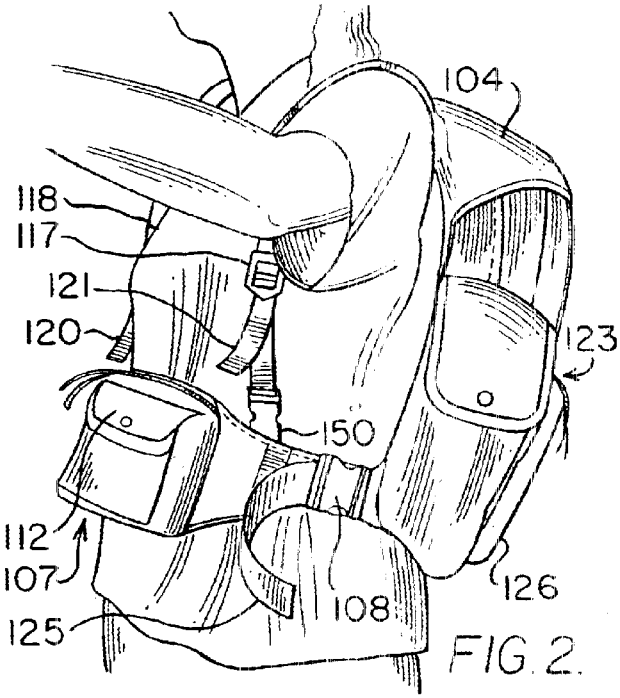
FIG. 2 is a right side perspective view of the preferred embodiment of the invention shown on a user.

Tail 121 and 120 of shoulder strap 105 and 106, respectively are each connected to pouch belt 109 and 111, respectively. The length of shoulder strap 105 and 106 can be adjusted by strap adjustment 117 and 118, respectively. Buckles 150 with parts 150*a*, 150*b* and with parts 151*a*, 150*b* connected to shoulder straps 105 and 106 respectively, allow a user to quickly release the shoulder strap for ease of turning the pack to a user's front as shown in FIG. 2. This feature can be useful while riding a bicycle for example. Loops 113 and 114 are attached to shoulder straps 105 and 106 for holding items.

Side pockets 122 and 123 are attached to side panel 103 and 102 respectively.

Loop 115 is connected to rear panel 101 and is used for storing or holding the invention when it is not in use. For example, the invention may be hung from 115 from a peg or other support.

FIG. 2 is a perspective view of the invention shown on a user. Pouch 107 is shown in front of a user. The arrangement of tail 120 and 121 to pouch belt 111 and 109 is also shown. Rear pouch 126 is attached to a rear portion of the invention.

Figure 3:
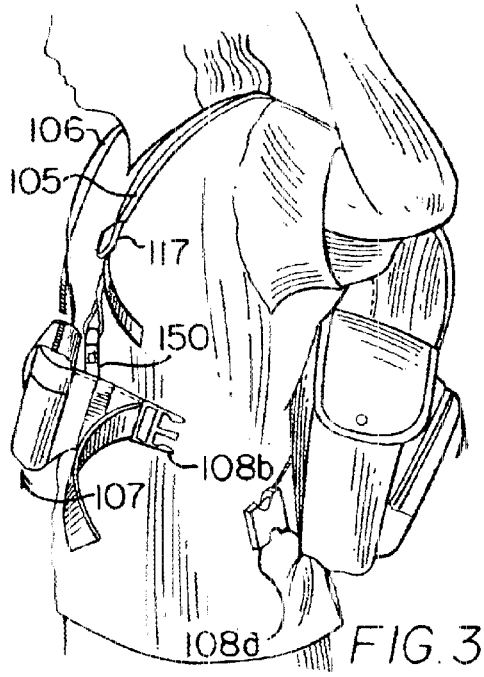
FIG. 3 is a right side perspective view of the preferred embodiment of the invention shown on a user with the belt unsnapped.

FIG. 3 is a perspective view of the invention shown on a user with the belt unsnapped. Buckle 108 is shown detached. It comprises male portion 108*b* and female portion 108*a*. Although buckle 108 is shown as a two-part buckle, any buckle or snap allowing the belt to be opened in the manner shown is acceptable.

In use, both buckles, 108 and 110, are opened. Buckles 150 and 151 may also be opened to facilitate rotation of the pack. The user then may rotate the pack about his/her neck to allow access to the pack without the need to remove the pack from the user's back. This is particularly advantageous when a user is wearing gear such as a helmet, shoulder pads, or overclothing. The prior art packs would normally have the user remove much, if not all, of the gear in order to remove the pack by lifting it over the user's head.

Figure 4:
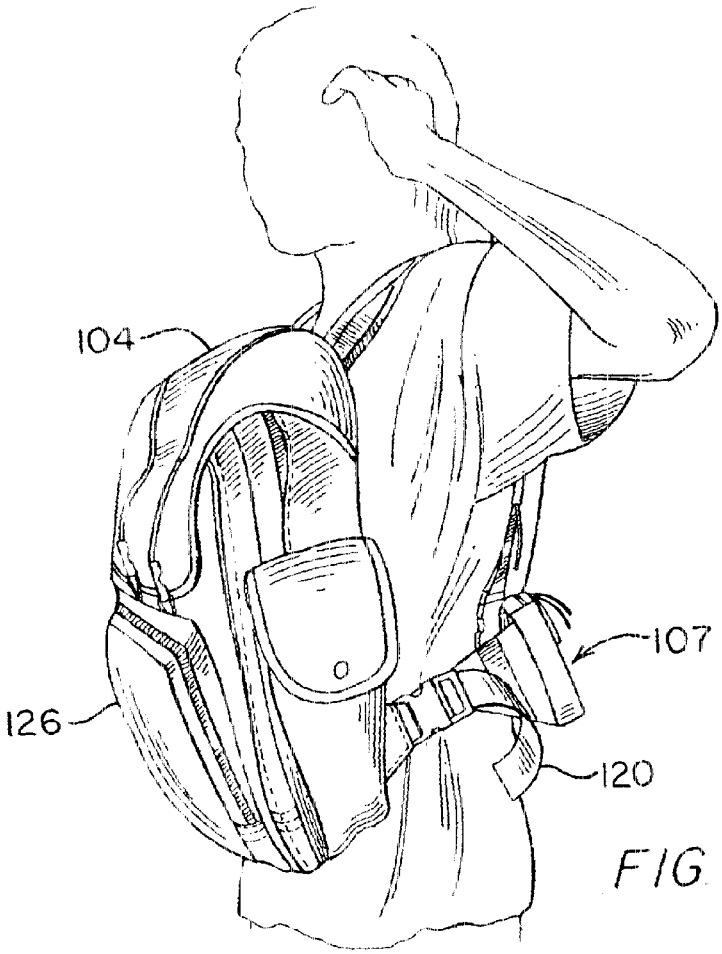
FIG. 4 is a rear perspective view of the preferred embodiment of the invention shown on a user in a second forward position to allow access to the pack.

FIG. 4 is a perspective view of the invention shown on a user in a second position to allow access to the pack. Once buckle 108 is opened, a user then rotates the invention about the user's neck. This brings the pack from the users back to his/her front. Once the pack is oriented at the user's front, then the user can look inside the pack, or generally access the pack to locate and retrieve the item(s) of interest. This arrangement allows a user to retrieve articles from the pack without removing the pack. This is particularly useful when the user is where protective equipment, such as a helmet, raingear or poncho, or shoulder pads.

Figure 5:
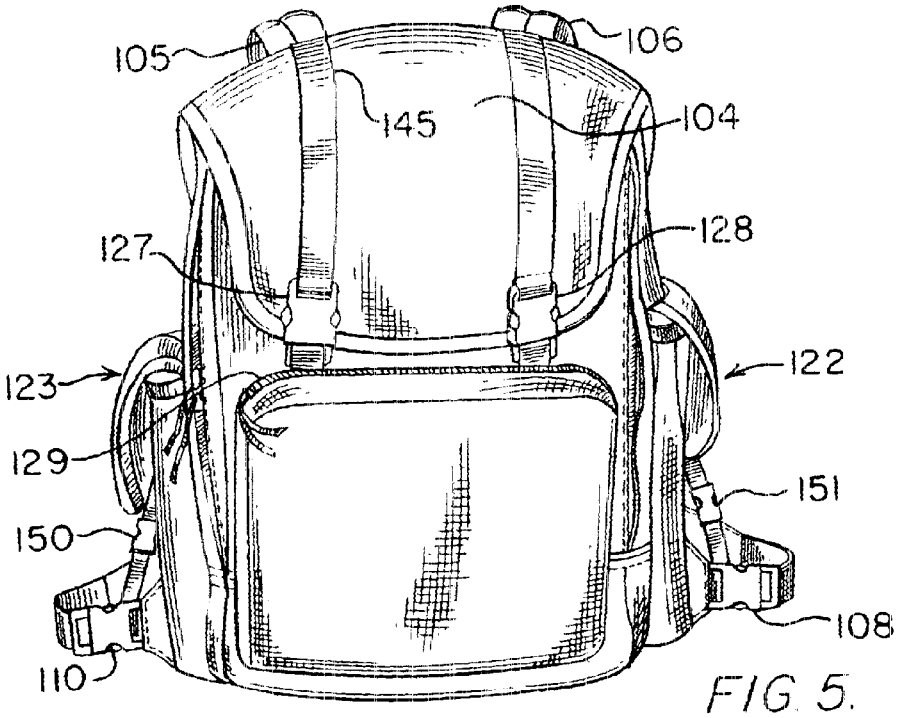
FIG. 5 is a rear elevation view of the preferred embodiment of the invention.

FIG. 5 is a rear elevation view of the invention. Snaps 127 and 128 are used to secure flap 104 when in the closed position. Pouch 126 is attached to the rear of the pack and can be used to store items. Shoulder strap 105 and 106 is connected to pack at connection 145 and 146 respectively.

Figure 6:
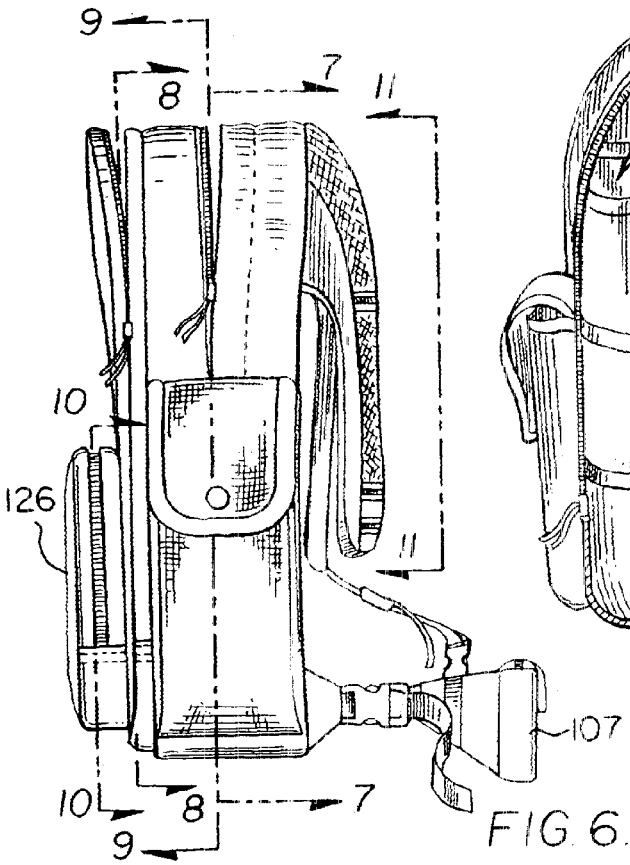
FIG. 6 is a left side elevation view of the preferred embodiment of the invention showing the cut lines described in FIGS. 7, 8, 9, 10 and 11.

FIG. 6 is a side elevation view of the invention showing the cut lines described in FIGS. 7, 8, 9, 10 and 11.

Figure 7:
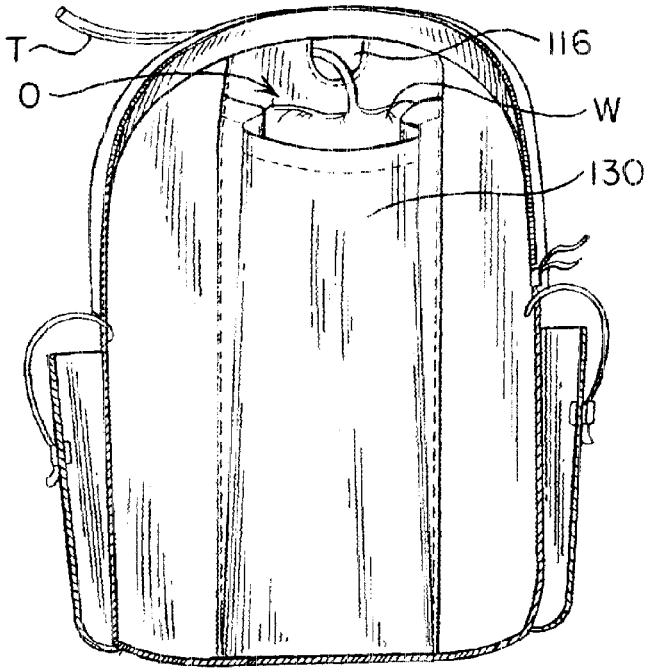
FIG. 7 is an elevation view of the invention through line 7—7 of FIG. 6.

FIG. 7 is an elevation view of the invention through line 7—7. Pocket 130 has opening O. Pocket 130 is used to hold any appropriately sized item, but more particularly, it may be used to hold a water bottle or pouch W. A tube T is then routed from the water pouch W through opening 116. The tube T then extends to a point where a user can easily access the tube T with the user's mouth. This allows a user to have ready access to water in the pack without the need to stop whatever activity the user is engaged in.

Figure 8:
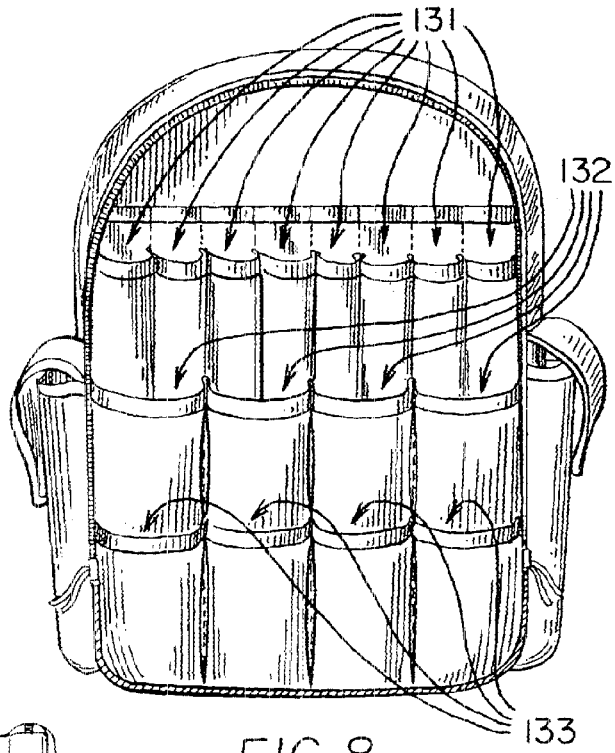
FIG. 8 is an elevation view of the invention through line 8—8 of FIG. 6.

FIG. 8 is an elevation view of the invention through line 8—8. Pockets 131, 132, and 133 are shown arranged in parallel rows. Each pocket is used to hold a tool, for example, for maintaining a bike, motorcycle or other piece or equipment. They are sized in order to accommodate a wide variety of tools and other useful devices, including but not limited to air compressors, tire irons, spare inner tubes, as so on in addition to tools.

Figure 9:
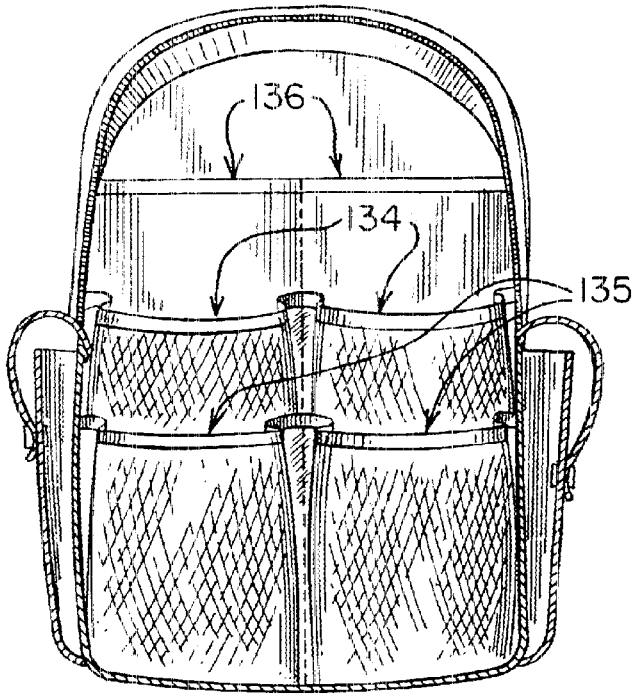
FIG. 9 is an elevation view of the invention through line 9—9 of FIG. 6.

FIG. 9 is an elevation view of the invention through line 9—9. Pockets 134, 135, and 136 comprise mesh material. These are used to hold items such as clothing, covers, ground clothes or rags. They may also be made of waterproof material suitable for holding damp or wet items.

Figure 10:
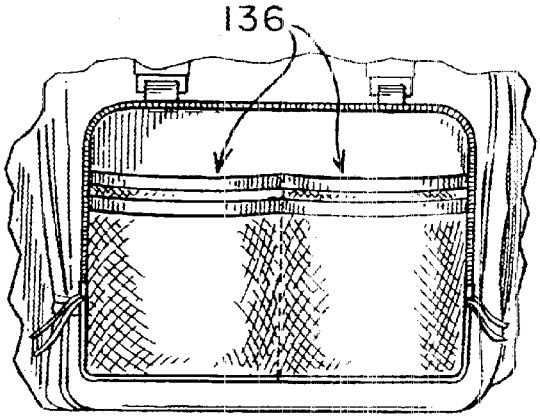
FIG. 10 is an elevation view of the invention through line 10—10 of FIG. 6.

FIG. 10 is an elevation view of the invention through line 10—10. Pockets 136 are shown for containing items.

Figure 11:
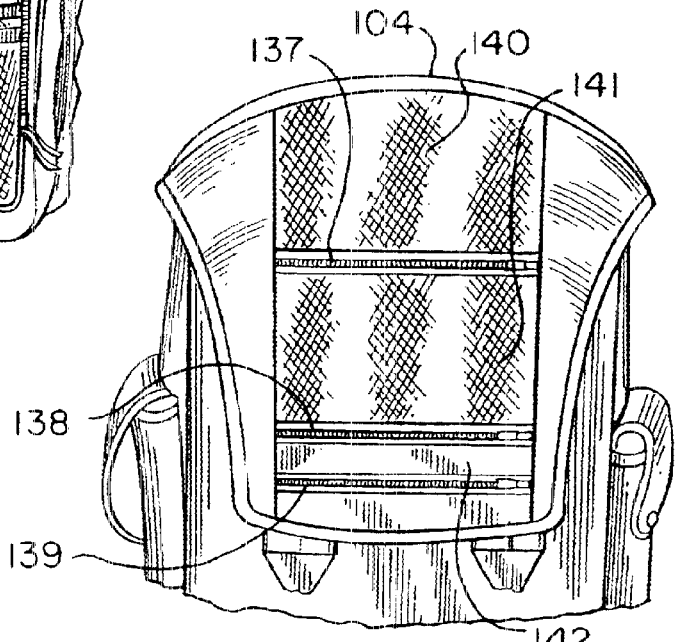
FIG. 11 is an elevation view of the invention through line 11—11 of FIG. 6.

FIG. 11 is an elevation view of the invention through line 11—11. Pockets 140, 141, and 142 are shown with zipper closures 137, 138 and 139 respectively. Pockets may be made of mesh or waterproof material or other suitable material as described in FIG. 9.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A multi-compartment pack comprising:

a rear bag;

a belt having a first end and a second end and a front central portion, each of said ends attached to a lower portion of said rear bag, said belt having a first buckle;

said rear bag having a first shoulder strap and a second shoulder strap, each of said shoulder straps having a first end attached to an upper portion of said pack and a second end attached to said belt; and said first buckle located between a connection point of said first end of said belt to said rear bag and a connection point of said second end of said first shoulder strap to said belt; and wherein said belt further comprises a second buckle, said second buckle located between a connection point of said second end of said belt to said pack and a connection point of said second end of said second shoulder strap to said belt, wherein unsnapping both buckles allows a user to rotate said rear bag to his belly without removing said shoulder straps by forming a closed loop around his neck comprising the rear bag, the front central portion of the belt and the shoulder straps;

said front central portion of the belt further comprises a belly pouch attached to said belt, said front central portion of the belt being fully removable by releasing said first and second buckles and the left and right shoulder strap buckles.

2. The multi-compartment pack of claim 1, wherein said rear bag further comprises a compartment for containing a liquid container.

3. The multi-compartment pack of claim 1, wherein said rear bag further comprises a plurality of compartments in a first enclosure.

4. The multi-compartment pack of claim 3, wherein said rear bag further comprises a rear pouch.

5. The multi-compartment pack of claim 4, wherein said rear bag further comprises a plurality of pockets.

6. The multi-compartment pack of claim 4, wherein said rear bag further comprises a side pocket.

7. The multi-compartment pack of claim 3, wherein said rear bag further comprises a plurality of pockets in a second enclosure.

8. The multi-compartment pack of claim 1, wherein said rear bag further comprises a front surface having a compartment.

9. A multi-mode backpack comprising:

a first mode having a rear bag with shoulder straps, and a detachable waist belt having a rear portion attached to the rear bag and having a belly pouch, said detachable waist belt having a first buckle and a second buckle each located by a side of a user, thereby forming a front and the rear portion of the detachable waist belt;

wherein each of said shoulder straps has a buckle connection to the front portion of the detachable waist belt, and a connection to the rear bag;

a second mode having said first and second waist belt buckles open, thereby forming a closed loop encircling a user's neck, and said rear bag being rotatable to a forward position on a user;

wherein said closed loop comprises the front portion of the detachable waist belt, the rear bag, and the shoulder straps; and a third mode having said front portion of said waist belt fully detached from said rear bag and said shoulder straps via said first and second buckles and the left and right shoulder strap buckles.

10. The multi-mode backpack of claim 9, wherein said rear bag further comprises a first and a second enclosure.

11. The multi-mode backpack of claim 10, wherein said rear bag further comprises a rear pouch and a front surface having a storage compartment.

12. The multi-mode backpack of claim 9, wherein said rear bag has a vertically oriented water container compartment.

13. The multi-mode backpack of claim 10, wherein said rear bag further comprises a side pocket.

* * * * *